United States Patent [19]

Yamato et al.

[11] Patent Number: 4,727,846

[45] Date of Patent: Mar. 1, 1988

[54] METHOD OF CONTROLLING FUEL SUPPLY TO AN INTERNAL COMBUSTION ENGINE AT DECELERATION

[75] Inventors: Akihiro Yamato, Shiki; Takafumi Nishikawa, Utsunomiya, both of Japan

[73] Assignee: Honda Giken Kogyo K.K., Tokyo, Japan

[21] Appl. No.: 786,218

[22] Filed: Oct. 10, 1985

[30] Foreign Application Priority Data

Oct. 15, 1984 [JP] Japan ..... 59-214215

[51] Int. Cl.[4] ..... F02D 41/10

[52] U.S. Cl. ..... 123/493; 123/325

[58] Field of Search ..... 123/492, 493, 325, 326

[56] References Cited

U.S. PATENT DOCUMENTS 4,466,411 8/1984 Hasegawa et al. ..... 123/493 X
4,481,929 11/1984 Hasegawa ..... 123/489 X
4,493,300 1/1985 Hasegawa ..... 123/493 X
4,497,297 2/1985 Daniel et al. ..... 123/489 X

FOREIGN PATENT DOCUMENTS 137633 8/1982 Japan .

*Primary Examiner*—Tony M. Argenbright
*Attorney, Agent, or Firm*—Arthur L. Lessler

[57] ABSTRACT

The fuel supply to an internal combustion engine is decreased when the engine is in an operating region wherein the intake passage pressure is lower than a first predetermined value. The first predetermined value is corrected in response to detected atmospheric pressure encompassing the engine. Further, the fuel supply to the engine is interrupted when the engine is in a second operating region wherein the intake passage pressure is lower than a second predetermined value, which is lower than the first predetermined value. The second predetermined value is corrected in response to the detected atmospheric pressure, together with the first predetermined value.

8 Claims, 4 Drawing Figures

METHOD OF CONTROLLING FUEL SUPPLY TO AN INTERNAL COMBUSTION ENGINE AT DECELERATION

BACKGROUND OF THE INVENTION

This invention relates to a method of controlling the fuel supply to an internal combustion engine at deceleration, and more particularly to a fuel supply control method of this kind, which is intended to improve the driveability of the engine under low atmospheric pressure conditions such as at high altitudes.

An internal combustion engine is liable to emit a large amount of unburnt fuel when the intake pipe pressure becomes low, at deceleration or like low load operation, badly affecting the fuel consumption, the emission characteristics, etc. the engine. Particularly in an internal combustion engine provided with a three-way catalyst for purifying exhaust gases in the exhaust passage, emission of exhaust gases containing a large amount of unburnt fuel causes burning of the catalyst bed to thereby hinder the purification of noxious exhaust gas ingredients. To overcome this disadvantage, it has been proposed by the assignee of the present application to decrease the fuel supply to the engine to lean the air/fuel ratio of the mixture to be supplied to the engine when the engine is operating in a predetermined decelerating operating region (Japanese Provisional Patent Publication (Kokai) No. 57-137633).

According to this proposed method, the intake pipe absolute pressure is used to determine whether or not the engine is operating in the predetermined decelerating region (hereinafter called "the mixture-leaning effecting region"). Specifically, the engine is determined to be in the mixture-leaning effecting region if the intake pipe absolute pressure is lower than a predetermined value (hereinafter called "the leaning-determining value"), which is set in consideration of the temperature of the catalyst bed to be assumed during operation of the engine under standard atmospheric pressure, such as during running at low altitude. If it is determined whether the engine is operating in the mixture-leaning region with reference to the leaning-determining value thus set under standard atmospheric pressure, excessive leaning will be inevitable when the vehicle is running under low atmospheric pressure such as when running at a high altitude, resulting in degraded driveability of the engine and often in engine stalling. That is, the back pressure acting upon the engine is low under low atmospheric pressure, which makes the emission of exhaust gases smooth to thereby reduce the amount of residual gas in the cylinders, hence improve the engine combustibility. The improved combustibility causes reduction in the quantities of hydrocarbon (HC) and carbon monoxide (CO) contained in the exhaust gases, which in turn alleviates the burden on the three-way catalyst, whereby the temperature of the catalyst bed decreases. Therefore, it is possible, under low atmospheric pressure conditions, to set the leaning-determining value to a value lower than a value which is optimal under standard atmospheric pressure, to thereby enable expanding of the $O_2$ feedback effecting region whereupon the fuel supply quantity to the engine is controlled in a feedback manner in response to oxygen concentration in the exhaust gases such that the air/fuel ratio is maintained at a value that enables ideal combustion of the mixture, e.g. a theoretical air/fuel ratio, whereby the driveability of the engine is improved. Therefore, it is a requisite that the leaning-determining value, which defines the boundary between the $O_2$ feedback effecting region and the mixture-leaning region, should be set to an optimal lower value under low atmospheric pressure, e.g. during running at high altitudes, than that under standard atmospheric pressure.

On the other hand, when the intake pipe absolute pressure assumes a further lower value than the leaning-determining value, the catalyst bed can sometimes be burned even when leaning of the mixture is effected. In such case, it has been employed to interrupt the fuel supply to the engine (i.e., fuel cut). The fuel cut-determining value, which defines the boundary between the fuel cut-effecting region and the leaning effecting region, is also required to be set to a value lower than a value which is optimal under standard atmospheric pressure, for the same reason as stated with respect to setting of the leaning-determining value. That is, the range of the fuel cut effecting region should be made narrower under low atmospheric pressure, by setting the fuel cut-determining value to a more appropriate lower value, so as to avoid a drop in the engine output or engine torque to be caused by fuel-cut, thereby achieving improved driveability of the engine.

SUMMARY OF THE INVENTION

It is the object of the invention to provide a method of controlling the fuel supply to an internal combustion engine at deceleration, which is adapted to accurately discriminate, in response to atmospheric pressure under which the vehicle is running, an operating region where leaning of the air/fuel mixture is required as well as another operating region where fuel cut is required, so that the engine can cope with a wide change in the atmospheric pressure, as the vehicle travels from a low land to a high land, for instance, to thereby improve the driveability and emission characteristics of the engine.

According to the invention, there is provided a method of controlling the fuel supply to an internal combustion engine at deceleration, wherein the fuel supply to the engine is decreased when the engine is in a predetermined operating region where at least the intake passage pressure is lower than a predetermined value. The method according to the invention is characterized by comprising the following steps: (1) detecting atmospheric pressure encompassing the engine, and (2) correcting the above predetermined value in response to the detected atmospheric pressure.

According to another aspect of the invention, there is provided a method of controlling the fuel supply to an internal combustion engine at deceleration wherein the fuel supply to the engine is decreased when the engine is in a first predetermined operating region where at least the intake passage pressure is lower than a first predetermined value, and the fuel supply to the engine is interrupted when the engine is in a second predetermined operating region where the intake passage pressure is lower than a second predetermined value, which is lower than the first predetermined value. The method according to this aspect of the invention is characterized by comprising the following steps: (1) detecting atmospheric pressure encompassing the engine, and (2) correcting the first and second predetermined values in response to the detected atmospheric pressure.

The above and other objects, features and advantages of the invention will be more apparent from the ensuing detailed description taken in conjunction with the accompanying drawings.

DETAILED DESCRIPTION

The method according to the invention will now be described in detail with reference to the drawings.

Figure 1:
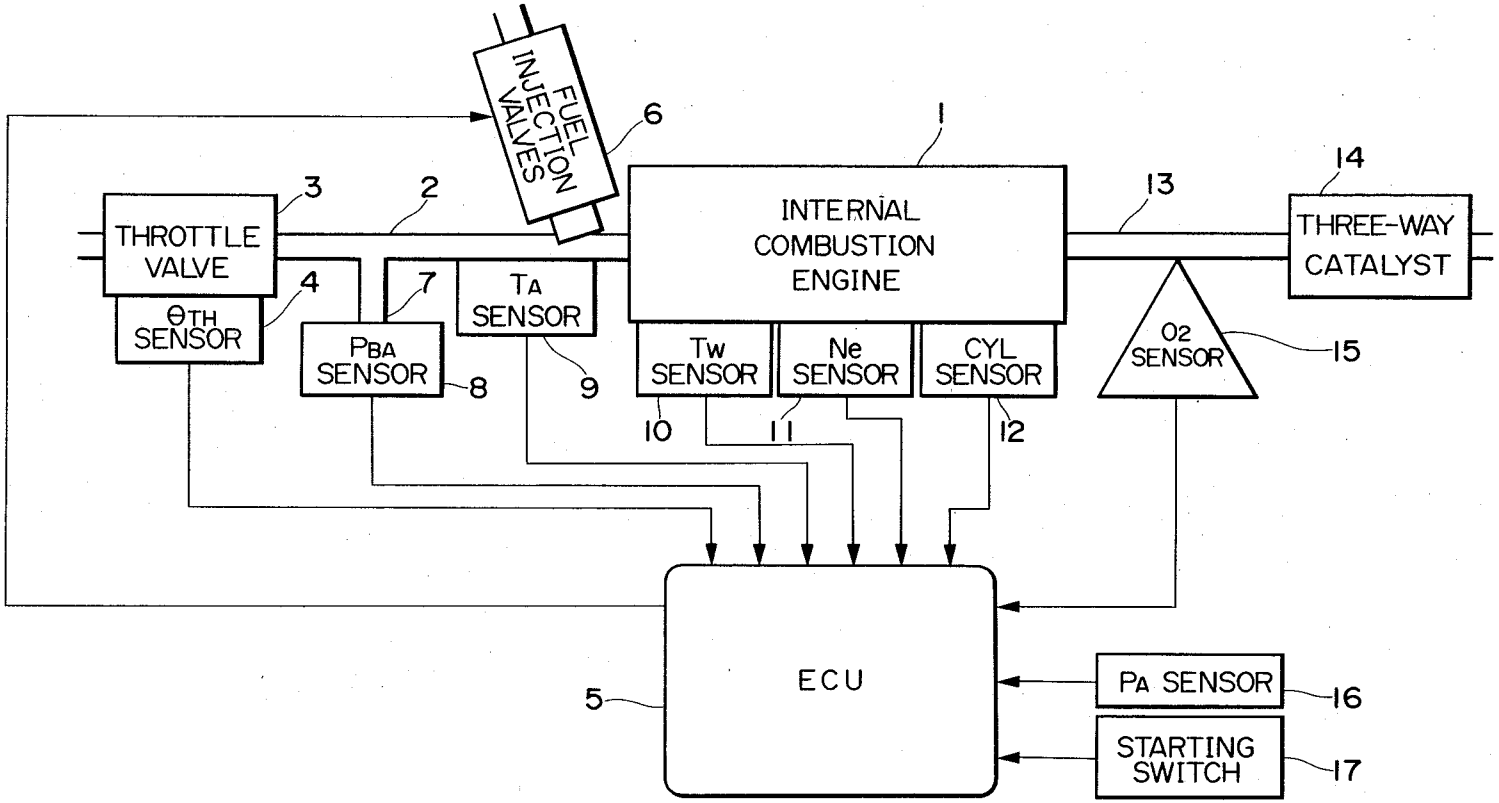
FIG. 1 is a block diagram illustrating the whole arrangement of a fuel supply control system for an internal combustion engine to which is applied the method of the invention.

Referring first to FIG. 1, there is schematically illustrated a fuel supply control system to which is applied the method according to the invention. Reference numeral 1 designates an internal combustion engine provided with a plurality of cylinders, e.g. four, to each of which is connected an intake pipe 2. A throttle valve 3 is arranged in the intake pipe 2. A throttle valve opening sensor (hereinafter called "the θTH sensor") 4 is connected to the throttle valve 3 for converting its opening into an electrical signal and supplying same to an electronic control unit (hereinafter called "the ECU") 5.

Fuel injection valves 6 are arranged in the intake pipe 2 at a location between the engine 1 and the throttle valve 3 and slightly upstream of an intake valve, not shown, of the intake pipe 2. The fuel injection valves 6 are connected to a fuel pump, not shown, and also each electrically connected to the ECU 5 to have their valve opening periods controlled by driving signals generated from the ECU 5.

An intake pipe absolute pressure sensor (hereinafter called "the PBA sensor") 8 is arranged to communicate with the intake pipe 2 via a pipe 7 at a location downstream of the throttle valve 3 for converting the absolute pressure in the intake pipe 2 into an electrical signal and supplying the latter to the ECU 5. Also, an intake air temperature sensor (hereinafter called "the TA sensor") 9 is provided at a location downstream of the PBA sensor 8 for converting the intake air temperature into an electrical signal and supplying same to the ECU 5.

An engine cooling water temperature sensor (hereinafter called "the TW sensor") 10 composed of a thermistor is mounted on the cylinder block of the engine 1 in a manner embedded in the peripheral wall of an engine cylinder having its interior filled with cooling water, for converting the cooling water temperature into an electrical signal and supplying same to the ECU 5.

An engine rotational speed sensor (hereinafter called "the Ne sensor") 11 and a cylinder-discriminating sensor (hereinafter called "the CYL sensor") 12 are arranged in faceing relation to a camshaft, not shown, of the engine 1 or a crankshaft of same, not shown. The Ne sensor 11 is adapted to generate an engine rotational speed signal, i.e., a pulse signal at each of particular crank angles of the engine each time the engine crankshaft rotates through 180 degrees, and the CYL sensor 12 is adapted to generate a pulse signal at a particular crank angle of a particular engine cylinder. These pulse signals are supplied to the ECU 5.

A three-way catalyst 14 is arranged in an exhaust pipe 13 of the engine 1 for purifying noxious components such as HC, CO and NOx contained in the exhaust gases. An oxygen concentration sensor (hereinafter called "the $O_2$ sensor") 15 is inserted in the exhaust pipe 13 at a location upstream of the three-way catalyst 14 for detecting the concentration of oxygen in the exhaust gases and supplying an electrical signal indicative thereof to the ECU 5.

Further electrically connected to the ECU 5 are an atmospheric pressure sensor (hereinafter called "the PA sensor") 16 for detecting the atmospheric pressure and a starter switch 17 for the engine 1, for supplying the ECU 5 with a signal indicative of the detected atmospheric pressure and a signal indicative of on-off positions of the starting swtich 17, respectively.

The ECU 5 operates in response to the various engine operation parameter signals stated above, to determine conditions in which the engine 1 is operating, e.g. an $O_2$ feedback effecting region, a mixture-leaning effecting region, and a fuel cut effecting region, and to calculate the fuel injection period TOUT for the fuel injection valves 6 in accordance with the determined operating conditions of the engine, by using the following equation:

$$TOUT = Ti \times KLS \times KO_2 \times K1 \times K2 \quad (1)$$

where Ti represents a basic fuel injection period, which is calculated as a function of the intake pipe absolute pressure PBA and the engine rotational speed Ne, and KLS represents a mixture-leaning coefficient which is determined by execution of a program as described later, and $KO_2$ an $O_2$ feedback coefficient which is set to a value corresponding to output signal from the $O_2$ sensor 15 when the engine 1 is in the $O_2$ feedback effecting region, and to a value 1.0 when the engine 1 is in an effecting region other than the $O_2$ feedback effecting region. K1 and K2 represent correction coefficients and correction variables, respectively, which are calculated on the basis of engine parameter signals from various sensors, namely the θTH sensor 4, the PBA sensor 8, the TA sensor 9, the TW sensor 10, the Ne sensor 11, the CYL sensor 12, the PA sensor 16 and the starter switch 17, to such values as to optimize various operating characteristics of the engine such as startability, emission characteristics, fuel consumption, and accelerability.

The ECU 5 operates on the basis of the fuel injection period TOUT determined as above to supply corresponding driving signals to the fuel injection valves 6.

Figure 2:
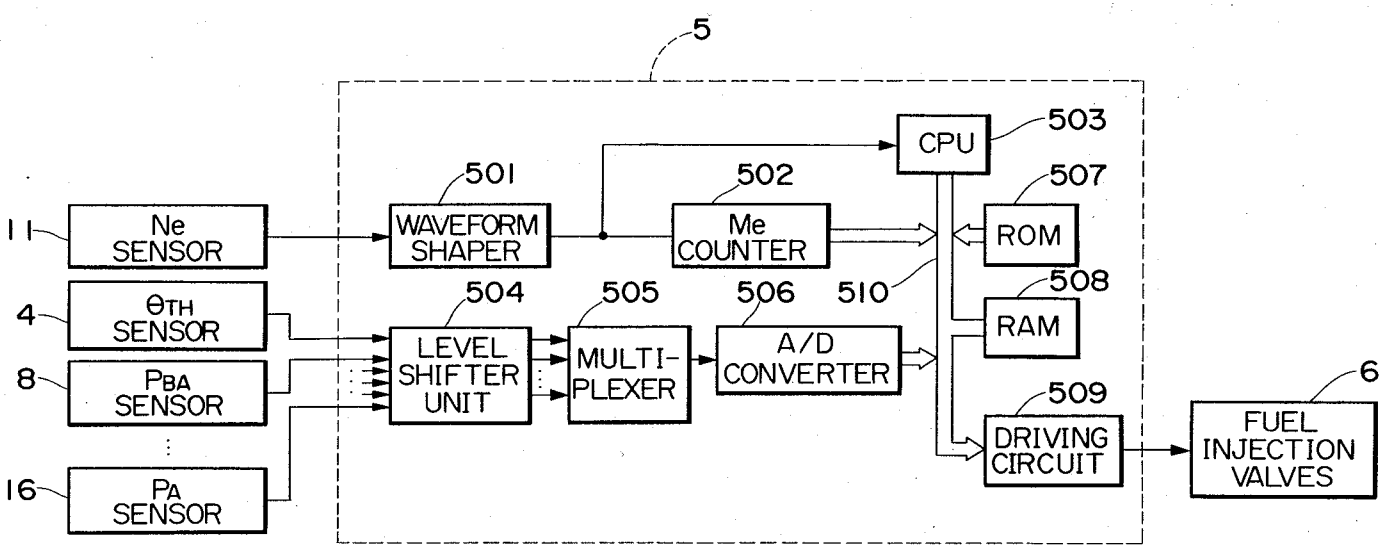
FIG. 2 is a block circuit diagram showing an arrangement within an electronic control unit of the fuel supply control system, appearing in FIG. 1.
Figure 3:
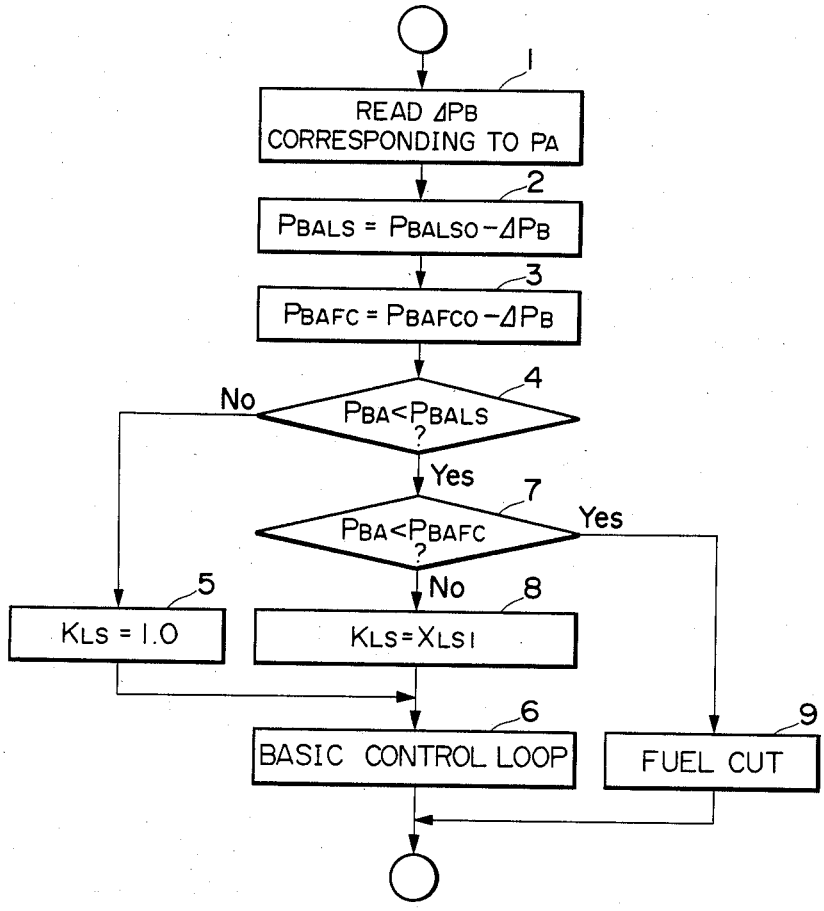
FIG. 3 is a flowchart showing a program for setting a mixture-leaning coefficient and determining the fuel cut effecting region according to the invention.

FIG. 2 shows a circuit configuration within the ECU 5. An engine rotational speed signal from the Ne sensor 11 has its pulse waveform shaped in a waveform shaping circuit 501, and is supplied to a central processing unit (hereinafter called "the CPU") 503, as an interrupt signal to start the program, which is shown in FIG. 3, as well as to an Me counter 502. The Me counter 502 counts the interval of time between a preceding pulse of the engine rotational signal from the Ne sensor 11 and a present pulse thereof, the value Me being thus proportional to the reciprocal of the actual engine speed Ne. The Me counter 502 supplies the counted value Me to the CUP 503 via a data bus 503.

Respective output signals from the θTH sensor 4, the PBA sensor 8, the PA sensor 16, etc. are applied to a level shifting unit 504, wherein they have their voltage levels shifted to a predetermined voltage level, and then successively supplied to an A/D converter 506 through a multiplexer 505. The A/D converter 506 successively converts output signals from the aforementioned sensors into respective corresponding digital signals, and the resulting digital signals are supplied to the CPU 503 via the data bus 510.

Further connected to the CPU 503 via the data bus 510 are a read-only memory (hereinafter called "the ROM") 507, a random access memory (hereinafter called "the RAM") 508, and a driving circuit 509. The RAM 508 temporarily stores various calculated values from the CPU 503, etc., and the ROM 507 stores a control program executed within the CPU 503, a basic fuel injection period Ti map for the fuel injection valves 6, a predetermined leaning-determining value and a predetermined fuel cut-determining value, which are corrected in response to the atmospheric pressure PA, as described later, etc. The CPU 503 executes the control program stored in the ROM 507 to calculate the fuel injection period TOUT for the fuel injection valves 6 on the basis of the aforementioned various engine parameters, and to supply the calculated value to the driving circuit 509 through the data bus 510. The driving circuit 509 supplies driving signals to the fuel injection valves 6, to open same for a period of time correcponding to the calculated fuel injection period value TOUT.

FIG. 3 shows, in the form of a flow chart, manners of setting the value of the mixture-leaning coefficient KLS and determining whether or not the engine is in a predetermined fuel cut effecting region referred to later, according to the method of the invention, which are executed within the CPU.

Figure 4:
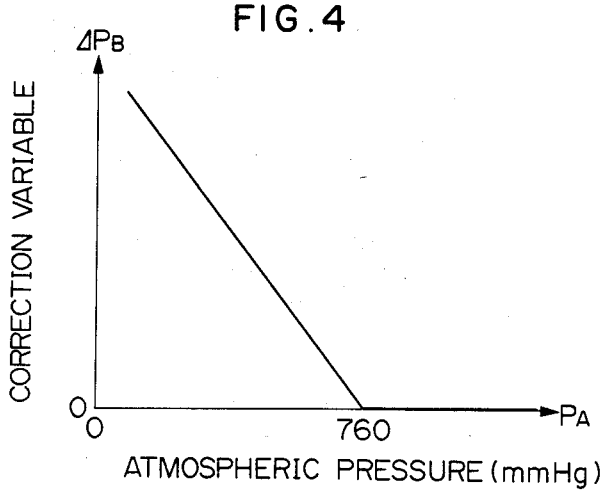
FIG. 4 is a graph showing the relationship between atmospheric pressure and a correction variable ΔPB.

First, a value of a correction variable ΔPB is read from a ΔPB table stored in the ROM 507, which corresponds to a signal representative of detected atmospheric pressure from the PA sensor 16 (step 1). FIG. 4 shows an example of the ΔPB table showing the relationship between the atomospheric pressure PA and the correction variable ΔPB. According to the table, the value ΔPB is set to decrease as the atmospheric pressure value PA increases, and when the value PA is equal to or higher than standard atmospheric pressure, i.e., 760 mmHg, the value ΔPB is set to zero. Then, at step 2 the leaning-determining value PBALS is set to a value equal to the difference between a predetermined reference leaning-determining value $PBALS_0$, which corresponds to the standard atmospheric pressure, and the value of the correction variable ΔPB set at above step 1. At step 3 the fuel cut-determining value PBAFC is set to a value equal to the difference between a predetermined reference fuel cut-determining value $PBAFC_0$, which corresponds to the standard atmospheric pressure, and the value of the correction variable ΔPB set at above step 1.

At step 4 it is determined whether or not the intake pipe absolute pressure PBA is lower than the leaning-determining value PBALS set at the above step 2, and if the answer is negative, that is, if the engine 1 is in the $O_2$ feedback effecting region, the mixture-leaning coefficient KLS is set to 1.0 (step 5), and the program proceeds to step 6.

If the answer to the question at step 4 is affirmative, the program proceeds to step 7, where it is determined whether or not the intake pipe absolute pressure PBA is lower than the fuel cut-determining value PBAFC set at above step 3. If the answer at step 7 is negative, it is judged that the engine 1 is in the mixture-leaning effecting region, and the program proceeds to step 8 to set the mixture-leaning coefficient KLS to a predetermined value $XLS_1$ (e.g. 0.9).

Then, the program proceeds to step 6, where a basic control loop is executed to effect calculation of the fuel injection period TOUT for the fuel injection valve 6 using the aforementioned equation (1). The mixture-leaning coefficient value KLS set at step 5 or step 8 is substituted in the equation (1).

If, on the other hand, the answer to the question at step 7 is affirmative, the engine 1 is judged to be in the fuel cut effecting region whereupon fuel cut is executed (step 9).

Each of the leaning-determining value PBALS and the fuel cut-determining value PBAFC may be provided with a hysteresis characteristic by setting same to different values between the time of entering the mixture-leaning region or fuel cut effecting region, and the time of departing therefrom, whereby a slight variation in the intake pipe absolute pressure PBA does not influence the determination of those operating regions to thereby achieve more stable engine operation.

In the present embodiment, although the same correction variable value ΔPB is.used at steps 2 and 3 in the flowchart in FIG. 3 of the invention, respective different values may be employed, depending upon the operating characteristics of an engine applied, the kind or operating characteristics of a three-way catalyst 15 used, etc.

Further, although according to the ΔPB table of the example of FIG. 4 the correction variable ΔPB varies linearly relative to the atmospheric pressure PA, a ΔPB table alternatively may be used wherein the correction variable ΔPB decreases in a step-like manner with the increase of the atmospheric pressure PA.

What is claimed is:

1. A method of controlling the fuel supply to an internal combustion engine at deceleration, said engine having an intake passage, wherein (i) the fuel supply to said engine is decreased when said engine is in a first predetermined operating region where leaning of the air-fuel mixture is required when the pressure in said intake passage is lower than a first predetermined value, and (ii) the fuel supply to said engine is cut when said engine is in a second predetermined operating region where fuel cut is required when the pressure in said intake passage is lower than a second predetermined value, said second predetermined value being lower than said first predetermined value, the method comprising the steps of:

(1) prestoring a correction variable look-up table having a one-to-one correlation between atmospheric pressure and a correction variable which decreases in value as the atomspheric pressure increases;

(2) detecting the atmospheric pressure encompassing said engine;

(3) selecting from said look-up table a correction value corresponding to the detected atmospheric pressure;

(4) setting said first predetermined value to a value equal to the difference between a first basic value corresponding to standard atmospheric pressure and said correction value; and (5) setting said second predetermined value to a value equal to the difference between a second basic value corresponding to standard atmospheric pressure and said correction value, whereby only a single look-up table is employed, and the same correction value is applied to both said first and second predetermined values.

2. A method as claimed in claim 1, wherein said pressure in said intake passage is detected in terms of absolute pressure.

3. A method as claimed in claim 1, wherein said step (4) comprises setting said predetermined value to lower values as the atmospheric pressure detected in step (2) decreases.

4. A method of controlling the fuel supply to an internal combustion engine at deceleration, said engine having an intake passage, wherein the fuel supply to said engine is decreased when said engine is in a first predetermined operating region where at least pressure in said intake passage is lower than a first predetermined value, and the fuel supply to said engine is interrupted when said engine is in a second predetermined operating region where said intake passage pressure is lower than a second predetermined value, which is lower than said first predetermined value, the method comprising the steps of:

(1) detecting atmospheric pressure encompassing said engine;

(2) setting first and second correction values corresponding to the detected atmospheric pressure; and (3) setting said first predetermined value to a value equal to the difference between a first basic value corresponding to standard atmospheric pressure and said first correction value, and setting said second predetermined value to a value equal to the difference between a second basic value corresponding to standard atmospheric pressure and said second correction value.

5. A method as claimed in claim 4, wherein said intake passage pressure is detected in terms of absolute pressure.

6. A method as claimed in claim 5, wherein said step (3) comprises setting each of said first and second predetermined values to smaller values as the atmospheric pressure detected in step (1) decreases.

7. A method as claimed in claim 5, wherein said step (2) comprises setting said first correction value and said second correction value to the same value.

8. A method of controlling the fuel supply to an internal combustion engine at deceleration, said engine having an intake passage, wherein the fuel supply to said engine is decreased when said engine is in a predetermined operating region where leaning of the air-fuel mixture is required when the pressure in said intake passage is lower than a predetermined value, the method comprising the steps of:

(1) prestoring a correction variable look-up table having a one-to-one correlation between atmospheric pressure and a correction variable which decreases in value as the atmospheric pressure increases;

(2) detecting the atmospheric pressure encompassing said engine;

(3) selecting from said look-up table a correction value corresponding to the detected atmospheric pressure; and (4) setting said predetermined value to a value equal to the difference between a basic value corresponding to standard atmospheric pressure and said correction value.

* * * * *

UNITED STATES PATENT AND TRADEMARK OFFICE

CERTIFICATE OF CORRECTION

PATENT NO. : 4,727,846

DATED : March 1, 1988

INVENTOR(S) : Akihiro Yamato, Takafumi Nishikawa

It is certified that error appears in the above-identified patent and that said Letters Patent is hereby corrected as shown below:

Column 8, line 6: change "5" to "4";

Column 8, line 10: change "5" to "4".

Signed and Sealed this

Fourth Day of October, 1988

*Attest:*

*Attesting Officer*

DONALD J. QUIGG

*Commissioner of Patents and Trademarks*